United States Patent [19]

Wright

[11] 4,023,174

[45] May 10, 1977

[54] MAGNETIC CERAMIC ABSORBER

[75] Inventor: Rufus W. Wright, Alexandria, Va.

[73] Assignee: The United States of America as represented by the Secretary of the Navy, Washington, D.C.

[22] Filed: Oct. 19, 1960

[21] Appl. No.: 63,699

Related U.S. Application Data

[63] Continuation-in-part of Ser. No. 720,513, March 10, 1958, abandoned.

[52] U.S. Cl. ..... 343/18 A

[51] Int. Cl.[2] ..... H01Q 17/00

[58] Field of Search ..... 252/62.5; 343/18 A; 333/22–24 B, 81

[56] References Cited

UNITED STATES PATENTS

| | | | |
|---|---|---|---|
| 2,464,006 | 3/1949 | Tiley | 343/18 A |
| 2,579,267 | 12/1951 | Leverenz et al. | 252/62.5 S |
| 2,745,069 | 5/1956 | Hewitt | 333/22 X |
| 2,764,743 | 9/1956 | Robertson | 343/18 A |
| 2,870,439 | 1/1959 | Stinehelfer | 343/18 A |
| 2,925,389 | 2/1960 | Esveldt et al. | 252/62.5 |
| 2,961,407 | 11/1960 | Piekarski | 252/62.5 |
| 2,977,591 | 3/1961 | Tanner | 343/18 A |
| 2,985,880 | 5/1961 | McMillan | 343/18 A |

FOREIGN PATENTS OR APPLICATIONS

| | | | |
|---|---|---|---|
| 507,981 | 12/1954 | Canada | 343/18 A |

OTHER PUBLICATIONS

"The Schornsteinfeger Project"; May 1945; Combined Intelligence Objectives Sub–Committee Report Item No. I File No. XXVI–24; Declassified Apr. 26, 1960; pp. 25–29, 89 and 93–95 relied on.

"Work of Professor Huttig on Ferromagnetic Substances for Use in Radar Camouflages"; 1946; B.I.O.S. Final Report No. 871 Item No. 1; British Intelligence Objectives Sub–Committee; pp. 4, 5 and 14 to 18 relied on; Declassified Apr. 26, 1960.

"Darkflex–A Fibrous Microwave Absorber"; NRL Report 4137, Apr. 20, 1953; Naval Research Laboratory, Washington, D.C.; 10 pages.

Montgomery, C. G.; Principles of Microwave Circuits; MIT RLS vol. 8; McGraw Hill 1948; pp. 396–400.

*Primary Examiner*—Malcolm F. Hubler

*Attorney, Agent, or Firm*—R. S. Sciascia; Philip Schneider; G. J. Crasanakis

EXEMPLARY CLAIM

1. A broadband microwave absorber comprising a sheet of magnetic ceramic material having the general formula, $MOFe_2O_3$, in which $Fe_2O_3$ is present in an amount in the range of between about 65 and 80 percent by weight of said material and in which MO represents bivalent metal oxides containing at least nickel oxide and zinc oxide, said nickel oxide being present in an amount of between about 3 and 12 percent by weight and said zinc oxide being present in an amount of between about 15 and 25 percent by weight, and including bivalent metal oxides selected from the group consisting of manganese oxide, calcium oxide and magnesium oxide, said manganese oxide being present in an amount of between about 0 and 10 percent by weight, said calcium oxide being present in an amount of between about 0 and 2 percent by weight and said magnesium oxide being present in an amount of between about 0 and 2 percent by weight, said sheet having a thickness which is substantially an electrical quarter wavelength at the lower range of microwave frequencies.

2 Claims, 4 Drawing Figures

INVENTOR
RUFUS W. WRIGHT

BY Richard C. Reed
ATTORNEY

MAGNETIC CERAMIC ABSORBER

The invention described herein may be manufactured and used by or for the Government of the United States of America for governmental purposes without the payment of any royalties thereon or therefor.

This application is a continuation-in-part of application Ser. No. 720,513, filed Mar. 10, 1958, entitled "Broadband Electromagnetic Wave Absorber", now abandoned.

The present invention relates to a broadband absorber for suppressing electromagnetic radiation and more particularly to magnetic ceramic materials capable of reducing the reflection of microwave energy.

In the prior art, the use of ferrite powders in absorptive materials was based on the knowledge that dissipative materials alone in their natural form were not satisfactory and that more desirable properties could be obtained in mixtures of dissipative particles suspended in nondissipative matrices. Artificial dielectrics have been formed by loading particles magnetic metals, semiconductors, ferromagnetic oxides or ferrites into base dielectrics to provide loaded type materials with more desirable magnetic and dielectric properties. The use of solid ferrites, i.e., ferromagnetic ferrites formed of ferric oxide and other bivalent metal oxides, as sheet materials for reflecting surfaces and objects to suppress or substantially reduce the reflection of electromagnetic energy offers many advantages. Mixed ferrites of the type referred to in the previously mentioned parent application, Ser. No. 720,513, provide good absorptive materials, especially at the low microwave frequencies. In addition, ferrites in the form of solid coatings display the higher permeabilities which are required for broadband operation. Solid ferrite coatings are capable of higher permeabilities, higher than those encountered in the ferrite powders, since the magnetic properties of a ferrite decline appreciably by grinding it into powder form. Ferrites that are both nonconductive and ferromagnetic provide within a single composition the opportunity to obtain a nearly optimum match of dielectric and magnetic properties. It is also noted that the magnitude of absorption for solid ferrites is large in comparison with that in conducting ferromagnetic materials, since in a ferrite its greater skin depth caused by its higher resistivity permits a relatively large volume of the ferrite to participate in the absorption process.

It is therefore an object of the present invention to provide mixed ferrite compositions which are capable of absorbing wave energy over a broad band of frequencies.

Another object of this invention is to provide a a ceramic coating which is both ferromagnetic and nonconductive and has improved magnetic as well as dielectric properties over a wide range of microwave frequencies.

A further object of this invention is to provide solid magnetic ceramic structures for reflecting surfaces and objects as absorptive materials for suppressing or minimizing the reflection of microwave energy back to the source.

A still further object of this invention resides in the provision of thin slabs and pyramidal structures formed of mixed ferrite compositions which are applied to reflecting surfaces and objects for the purpose of shielding them from radio-echo detecting devices.

Other and further objects of the present invention will become apparent by reference to the following description taken in connection with the accompanying drawing, wherein.

Figure 1:
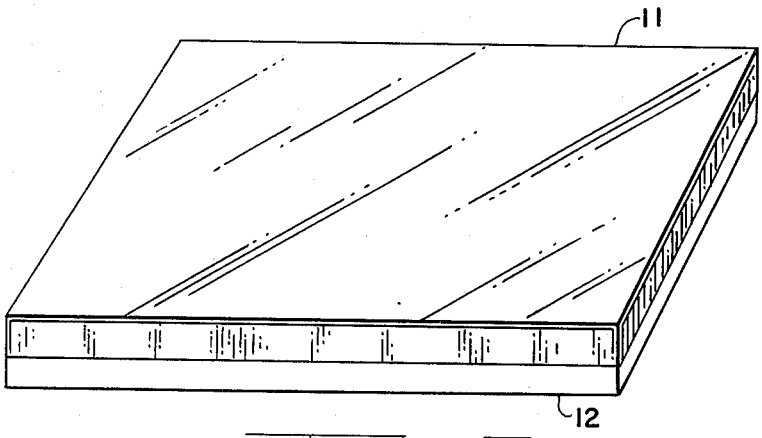
FIG. 1 is a plan view of a thin, flat absorber of ferrite composition in accordance with the present invention.

In accordance with the present invention, in order to obtain the above objectives a wave absorber is formed of magnetic ceramic materials of the type generally known as mixed ferrites. Mixed ferrites are crystal type compounds of a spinel structure having a formula of $(MO)Fe_2O_3$ in which MO stands for more than one bivalent metal oxide in the crystal structure. In particular, the magnetic ceramic materials of the present invention consist essentially of nickel-zinc ferrites and nickel-manganese-zinc ferrites which may also include relatively small amounts of magnesium and calcium. The total proportion of bivalent oxides (nickel oxide, zinc oxide, manganese oxide, magnesium oxide and calcium oxide) in the composition is approximately equal to the mol percent of $Fe_2O_3$.

This invention is based on the discovery that within the limits of composition as described herein, the Ni-Zn ferrites and Ni-Mn-Zn ferrites provide absorptive sheets of either planar or pyramidal surface configurations which are capable of minimizing the reflection of electromagnetic waves ranging from about 50 to 60,000 megacycles per second, and ferrite structures have also been found effective as wave absorbers even in the very high frequencies extending beyond 100,000 megacycles per second.

Any substance becomes a resonant absorber if its thickness is an odd multiple of one-quarter of the wavelength of the incident radiation measured inside the substance and if the material has the proper loss factor for this thickness. In order to change the resonant absorption frequency, it becomes necessary to change the physical thickness of the absorber. The present invention, however, circumvents this requirement by providing for compositions whose complex dielectric constant and magnetic permeability vary in such a manner that the absorber remains resonant over a wide range of frequencies without a change in physical thickness.

Broadband absorption is thus possible by the use of the present mixed ferrites in which a variation in magnetic permeability and dielectric constant occurs with variation in frequency at a relatively constant rate so that the required physical thickness of the ferrite to equal an electrical quarter wavelength remains approximately constant throughout the lower microwave range of the absorber. By the term "electrical quarter wave length" it is understood to mean a physical thickness T of a material with index of refraction $n$ such that $nT$ is equal to a quarter wavelength of the incident radiation in air.

Considering further the broadband feature of the present ferrites the electrical wavelength of a given frequency in a material other than air is equal to $$\frac{\lambda \text{ air}}{\sqrt{|\mu_1 \epsilon_1|}},$$

where λ air is the wavelength of the given frequency in air, (equal to C/f where $f$ is the frequency and C is the velocity of light), $\mu_1$ is the permeability of the material other than air, and $\epsilon_1$ is the dielectric constant of the material other than air. The thickness of the absorber at the lower range of microwave frequencies must be an electrical quarter wavelength thick, therefore:

$$T \text{ (thickness)} = \frac{\lambda \text{ material}}{4} = \frac{\lambda \text{ air}}{4\sqrt{|\mu_1 \epsilon_1|}} = \frac{C}{4f\sqrt{|\mu_1 \epsilon_1|}}$$

The necessary thickness of material for maintaining a resonance condition of an electrical quarter wavelength will remain constant as long as the product of the frequency and the square root of the product of permeability and dielectric constant remains a constant. Measurements of $\mu$ and $\epsilon$ for Ni—Zn and Ni—Mn—Zn ferrites indicate that at the lower range of frequencies these materials possess desirable magnetic and electrical properties which, in accordance with the broadband aspects discussed above, provide practical, flat resonant absorber sheets over a wide range of frequencies. The $\mu$ and $\epsilon$ values obtained at different frequencies for these ferrites are in agreement with the mathematical relationship, i.e., the product of $\mu_1\epsilon_1$ varies inversely with the frequency, such variation occurring proportionally and maintaining a nearly constant value for the expression, $4f \sqrt{M_1E_1}$. Thus, the quarter wavelength feature of the present ferrite absorber is based on an effective thickness for the ferrite material which remains substantially an electrical quarter wavelength over a wide range of microwave frequencies.

Figure 2:
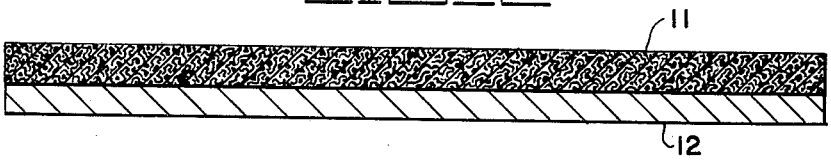
FIG. 2 is a cross-section view of the absorber of FIG. 1.

Referring now to FIG. 1, the basic structure of the magnetic ceramic absorber is a thin, flat layer or slab 11 of ferrite composition, having a cross-section as shown in FIG. 2 depicting a sintered mixture of bivalent metal oxides and ferric oxide. The flat layer is shown against a metal surface 12 which is to be shielded from microwave radiation. Proper choice of thickness for the layer or slab results in an absorber which exhibits resonant thickness at the selected low frequency limit. The index of refraction must change as the frequency changes (from the selected low frequency limit) in such a manner as to keep the layer substantially resonant over a selected frequency range. A flat sheet of less than about 0.350 inch in thickness gives a reflection of less than 5% power in the frequency range of about 50 to 1000 megacycles.

The absorber can be made extremely broadband by adopting a geometric taper into the material. This will continue the broadband performance past the high frequency limit of the flat sheet where the index of refraction ( $\sqrt{\mu_1\epsilon_1}$ ) no longer changes properly to maintain a resonant thickness in a flat sheet.

Figure 3:
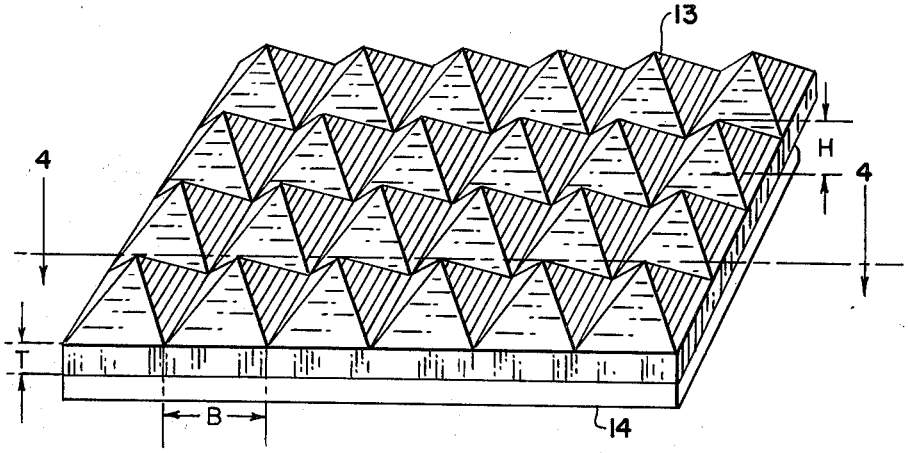
FIG. 3 is a plan view of another embodiment of the present invention showing a surface configuration of adjoining pyramids.

Referring now to the embodiment shown in FIG. 3, the mixed ferrites are sufficiently high loss and may be formed into a surface dentate configuration of pyramids 13 to extend the high frequency absorbing ability of the structure beyond the operable range of the flat sheet of FIG. 1 and with little or no change in its effectiveness at the lower frequencies. A surface of adjoining pyramids of height H and base width B are shown on a support base having a thickness T; the pyramids and base being integrally formed of the same ferrite and positioned against a reflecting surface 14. Preferably, the height of the pyramid H measures approximately 2 to 8 times the thickness T of the support base, while the pyramidal width B is approximately 2 to 4 times the thickness T of the support base.

Figure 4:
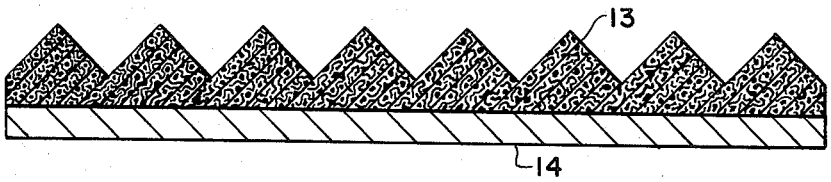
FIG. 4 is a cross-section view of the pyramidal structure of FIG. 3 taken on the line 4-4.

The cross-section view of the pyramidal structure in FIG. 4 illustrates a sintered composition. The structure may be conveniently formed by pulverizing and mixing the specified bivalent metal oxides and ferric oxide along with a small addition of 1–2% of an organic binder and 5% of water. This mixture is moldable and can be shaped into pyramids with the specified support base and dimensional relationships specified for the present embodiment. The molded pyramidal structures may then be fired at temperatures of between 1200° to 1400° C and preferably at about 1200° to 1300° C. Of course, it will be appreciated that the surface configuration of pyramids for the mixed ferrites, shown in FIGS. 3 and 4, may be constructed in any manner, since the invention is not limited to the sintered technique as disclosed herein.

In accordance with this invention, a pyramidal ferrite absorber of ½ to 1 inch in height on a ⅛ to ¼ inch thick support base will absorb over 95% of the incident radiation over the frequency range of 100 to 10,000 megacycles per second. For Ni—Zn ferrite compositions, measurements between 10,000 to 30,000 megacycles per second and near 60,000 megacycles per second show that the loss in this pyramidal absorber remains sufficiently high so that reflections of more than 5% power cannot occur in this region.

In practice, thin, solid ferrite sheets, as thin as 0.100 inch, may be applied to metal surfaces to offer practical means of protection from reflection of microwave radio wavelengths where such unwanted radio echoes occur. Raw materials for the ferrites are not expensive so that ceramic type layers of these ceramic materials may be preformed and attached in a variety of ways to surfaces that are to be protected.

The overall ferrite compositions which are found useful as microwave absorbers in accordance with this invention may vary between the approximate limits shown in the table below:

| | Percent by Weight |
|---|---|
| NiO | 3–12 |
| ZnO | 15–25 |
| MnO | 0–10 |
| CaO | 0–2 |
| MgO | 0–2 |
| $Fe_2O_3$ | 65–80 |

The following examples illustrate the manner in which the ferrites of the present invention are utilized as microwave radiation absorbers and the operative ranges of said absorbers as they relate to appropriate thickness and surface configurations for the specific ferrite compositions employed.

EXAMPLE 1

A nickel-manganese-zinc ferrite comprising 5.2% nickel, 3.25 manganese and 14.2% zinc was sintered from a pulverized mixture of the following ingredients:

| | Percent by Weight |
|---|---|
| NiO | 6.6 |
| ZnO | 17.74 |
| MnO | 5.4 |
| CaO | 0.56 |
| MgO | 1.0 |
| $Fe_2O_3$ | 68.7 |

The microwave radiation absorber formed from this composition was a relatively thin, flat layer, 0.217 inch thick. The thin layer was tested as a microwave absorber by mounting it in a coaxial line in which a slotted section was used to measure the phase and amplitude of the wave reflected by the sample ferrite. On being tested for absorption of microwave radiation, said absorber was found to be excellent for frequencies of between 200 and 1000 megacycles per second. Reflected power in this frequency range was not more than 2% of the incident power level.

EXAMPLE 2

A microwave radiation absorber was made into a tapered pyramidal section having an identical ferrite composition as the absorber in Example 1. The ferrite pyramids were ¾-inch in height with a ½-inch base width and resting on a ⅛-inch thick support base, the pyramids and support base being integrally constructed of a solid piece of ferrite. The absorber was tested in a coaxial line to determine the energy absorption to 1000 megacycles per second; in the range of between 1000 and 3000 megacycles per second, the measurements were made in a rectangular waveguide with slotted sections. The sample in both the coaxial and waveguide lines was mounted at the end of the line against a metal shorting wall, care being taken in each instance to prevent air gaps between the sample and the metal wall. In the range between 3,000 and 30,000 megacycles per second, the ferrite sample was transferred and measured in open space under a circular arch. Energy transmitted from a horn-type radiator, mounted on the arch, was reflected from a metal plate centered under the arch to a similar receiving horn. With the metal plate in place the gain of the receiver is adjusted to read 100. The ferrite sample is then placed upon the metal plate (ferrite sample and plate having the same size) and the reflection from the ferrite sample was compared with that from the metal plate. Upon substitution of the ferrite sample, the meter reads directly the power reflected from the ferrite.

Measurements in the range of 100 to 1000 megacycles per second showed a power reflection of less than 5% for the pyramidal ferrite absorber as compared with that from a similar size metal plate. This reflection of 5% corresponds to an absorption of 95%. These measurements are for incident energy approximately normal to the reflecting surface.

EXAMPLE 3

Solid broadband microwave radiation absorbers were constructed of a nickel-zinc ferrite comprising 9.1% nickel and 16.3% zinc. The Ni-Zn ferrite was sintered from a pulverized mixture of oxides in the following proportions:

| | Percent by Weight |
|---|---|
| NiO | 11.5 |

-continued

| | Percent by Weight |
|---|---|
| ZnO | 20.3 |
| CaO | 0.14 |
| MgO | 0.16 |
| $Fe_2O_3$ | 67.9 |

A relatively thin sheet, 0.347-inch thick, of an essentially flat surface of Ni—Zn ferrite was tested as an electrical energy absorbing material in a coaxial line and found to produce reflections of less than 2% power in the range between 50 and 400 megacycles per second, and less than 5% power to 600 megacycles.

EXAMPLE 4

A microwave radiation absorber identical in composition to the absorber in Example 3 was formed into a pyramidal configuration with pyramids ¾ inch in height and ½ inch in base width on a support base approximately ¼ inch thick. The pyramid structure was measured in a coaxial line, wave guide and in open space by means of a circular arch as described in Example 2. This Ni—Zn ferrite structure absorbs over 95% of the incident electrical energy over a frequency range of 100 to 30,000 megacycles per second. Further calculations on values obtained near 60,000 megacycles per second indicate that this material is capable of high absorption to 100,000 megacycles per second and good performance at even higher frequencies is indicated.

It may readily be seen that the foregoing ferrite structures provide electromagnetic energy absorbers with a broader band of effectiveness and higher absorption than was heretofore possible. The invention describes an extremely broadband absorber for normal incidence, but the invention also provides for improved absorption at oblique incidence, as those skilled in the art will readily recognize.

While the invention has been described in preferred embodiments and specific compositions, it should be understood that many modifications and variations are possible in the light of the above teachings and that within the scope of the appended claims the invention may be practiced otherwise than as specifically described.

What is claimed is:

1. A broadband microwave absorber comprising a sheet of magnetic ceramic material having the general formula, $MOFe_2O_3$, in which $Fe_2O_3$ is present in an amount in the range of between about 65 and 80 percent by weight of said material and in which MO represents bivalent metal oxides containing at least nickel oxide and zinc oxide, said nickel oxide being present in an amount of between about 3 and 12 percent by weight and said zinc oxide being present in an amount of between about 15 and 25 percent by weight, and including bivalent metal oxides selected from the group consisting of manganese oxide, calcium oxide and magnesium oxide, said manganese oxide being present in an amount of between about 0 and 10 percent by weight, said calcium oxide being present in an amount of between about 0 and 2 percent by weight and said magnesium oxide being present in an amount of between about 0 and 2 percent by weight, said sheet having a thickness which is substantially an electrical quarter wavelength at the lower range of microwave frequencies.

2. A broadband microwave absorber as recited in claim 1 in which said sheet has a magnetic permeability, $\mu_1$, and dielectric constant, $\epsilon_1$, that vary with frequency, $f$, in such a manner as to maintain essentially a constant electrical thickness, T, in said sheet in accordance with the following relationship:

$$T = \frac{c}{4f\sqrt{|\mu_1 \epsilon_1|}}$$

* * * * *